US007753031B2

(12) United States Patent
Akagi

(10) Patent No.: US 7,753,031 B2
(45) Date of Patent: Jul. 13, 2010

(54) FUEL INJECTION SYSTEM FOR AN INTERNAL COMBUSTION ENGINE AND ENGINE INCORPORATING SAME

(75) Inventor: Takashi Akagi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 394 days.

(21) Appl. No.: 11/893,203

(22) Filed: Aug. 15, 2007

(65) Prior Publication Data

US 2008/0210201 A1 Sep. 4, 2008

(30) Foreign Application Priority Data

Aug. 31, 2006 (JP) ..... 2006-234964

(51) Int. Cl.
*F02M 55/02* (2006.01)

(52) U.S. Cl. ..... 123/469; 123/470

(58) Field of Classification Search ..... 123/468, 123/469

See application file for complete search history.

(56) References Cited

U.S. PATENT DOCUMENTS 4,913,119 A * 4/1990 Usui ..... 123/456
5,095,876 A * 3/1992 Yonekawa et al. ..... 123/468
5,299,541 A * 4/1994 Yamaguchi et al. ..... 123/468
5,735,247 A * 4/1998 Tsuzuki et al. ..... 123/470
5,868,111 A * 2/1999 Augustin ..... 123/198 D
6,178,950 B1 * 1/2001 Stockner et al. ..... 123/470
6,196,192 B1 * 3/2001 Ciecko ..... 123/456
6,227,169 B1 * 5/2001 Sato et al. ..... 123/456
6,405,713 B1 * 6/2002 Scollard et al. ..... 123/468
6,564,775 B1 * 5/2003 Kikuta et al. ..... 123/456
6,732,711 B2 * 5/2004 Yanagii ..... 123/469
6,807,944 B2 * 10/2004 Mizuno et al. ..... 123/467
6,874,477 B1 * 4/2005 Lorraine et al. ..... 123/468
7,028,668 B1 * 4/2006 West et al. ..... 123/456
7,143,749 B1 * 12/2006 Colletti ..... 123/469
7,159,569 B2 * 1/2007 Keegan et al. ..... 123/456
7,263,975 B2 * 9/2007 Stieler et al. ..... 123/456
7,305,969 B2 * 12/2007 Ricco et al. ..... 123/456
7,415,968 B1 * 8/2008 Matas et al. ..... 123/456
7,415,970 B2 * 8/2008 Zdroik et al. ..... 123/470
7,591,246 B2 * 9/2009 Beardmore et al. ..... 123/456
2001/0042539 A1 * 11/2001 Ozeki ..... 123/470
2002/0023606 A1 * 2/2002 Schneider ..... 123/184.21

(Continued)

FOREIGN PATENT DOCUMENTS

JP 04350357 A * 12/1992

(Continued)

*Primary Examiner*—Stephen K Cronin
*Assistant Examiner*—Arnold Castro
(74) *Attorney, Agent, or Firm*—Carrier, Blackman & Associates, P.C.; William D. Blackman; Joseph P. Carrier

(57) ABSTRACT

A fuel injection system includes a fuel piping for supplying fuel to plural injectors of a multi-cylinder internal combustion engine, and a connection member for attaching the fuel piping to a vehicle. The fuel piping is divided into plural resin supply pipe members across the longitudinal direction thereof. The fuel piping also includes an introduction pipe member, made of resin, for supplying fuel to the supply pipe members. The connection member includes a plurality of injector engaging portions connected to the injectors, and a plurality clamping parts connected to the fuel piping. The connection member is fixed to a component of the vehicle together with the fuel piping.

22 Claims, 10 Drawing Sheets

U.S. PATENT DOCUMENTS

| | | | | |
|---|---|---|---|---|
| 2004/0079337 | A1* | 4/2004 | Akagi et al. | 123/456 |
| 2006/0201486 | A1* | 9/2006 | Taguchi et al. | 123/470 |
| 2006/0225708 | A1* | 10/2006 | Taguchi et al. | 123/468 |
| 2008/0202472 | A1* | 8/2008 | Whatley et al. | 123/469 |
| 2009/0145400 | A1* | 6/2009 | Hanneke et al. | 123/446 |

FOREIGN PATENT DOCUMENTS

| | | | |
|---|---|---|---|
| JP | 11-093802 | | 4/1999 |
| JP | 2003120467 | A * | 4/2003 |

* cited by examiner

FUEL INJECTION SYSTEM FOR AN INTERNAL COMBUSTION ENGINE AND ENGINE INCORPORATING SAME

CROSS-REFERENCE TO RELATED APPLICATIONS

The present application claims priority under 35 USC §119 based on Japanese patent application No. 2006-234964, filed on Aug. 31, 2006. The entire subject matter of this priority document is herein incorporated by reference.

BACKGROUND OF THE INVENTION

1. Field of the Invention

The present invention relates to a fuel injection system for an internal combustion engine having a plurality of cylinders. More particularly, the present invention relates to a fuel injection system having a plurality of fuel injectors and a fuel piping, having by a plurality of supply pipe members, which supplies fuel to the injectors.

2. Description of the Background Art

A number of fuel injection systems which supply fuel to plural fuel injectors of an internal combustion engine having a plurality of cylinders are known. An example of such fuel injection system for a vehicle engine, such as a motorcycle engine, is disclosed in the Japanese patent document JP-A No. H11-093802.

According to the Japanese patent document JP-A No. H11-093802, the fuel injection system for a motorcycle engine includes a plural fuel injectors and a fuel piping for supplying fuel to the plural injectors. The fuel piping includes a fuel introduction port for receiving fuel that is supplied (e.g., from a fuel tank via a fuel pump), a fuel path connecting the fuel introduction port, a plurality of injector connecting portions for connecting the injectors, and clamping parts for fixing the fuel piping to a vehicle component.

Generally, the fuel piping is integrally formed of an aluminum alloy or an extruded material, for example, as disclosed in JP-A No. H11-93802.

It is desirable that a fuel piping installed in a vehicle is of light weight. However, even with design changes, e.g. shape of fuel piping, there have been some constraints on reducing weight of the fuel piping which is generally made of a metallic material, such as aluminum alloy.

It is considered possible to reduce the weight of the fuel piping by manufacturing fuel piping using a light weight material, such as resin. However, integrally producing a long fuel piping made of a resin involves a moldability problem.

On the other hand, forming a long fuel piping by connecting shorter pipe members made of resin involves a functional problem. For example, the pipe members connected with each other may develop relative positional shifting between them, particularly at connecting portions, due to relatively rigid vehicle portions to which the fuel piping is attached.

In order to minimize relative positional shifting of the pipe members, the fuel pipings are generally formed of a metallic material resulting into heavy weight. Under such circumstances, fuel piping improvements are required in terms of both weight and cost. The present invention has been made in view of the above problem.

Accordingly, it is an object of the present invention to provide a fuel injection system which enables a reduction in weight of the system and improves manufacturability of required parts of the fuel injection system.

SUMMARY OF THE INVENTION

To achieve the above object, the present invention provides a fuel injection system having a plurality of injectors for injecting fuel; and a fuel piping which includes a fuel introduction port for receiving fuel that is supplied via a fuel pump (from a source such as fuel tank), a fuel path extending from the fuel introduction port, a plurality of injector connecting portions provided along the fuel path, and a plurality of clamping members for fixing the fuel piping to a component of a vehicle. The fuel piping supplies the fuel supplied by the fuel introduction port, via the fuel path, to the plurality of injectors connected to the injector connecting portions.

In the present fuel injection system, the fuel piping is divided into a plurality of resin pipe members (for example, the introduction pipe member 60 and supply pipe members 70 or 170 used in the embodiments of the present invention, described later), along a longitudinal direction in which the fuel path extends; a connection member (for example, the connection stay/member 80 or 180 used in the embodiments, described later) is aligned with the plurality of pipe members in a assembled (connected) state thereof, with a plurality of clamping members formed on each of the plurality of pipe members.

The connection stay is fixed to the vehicle component (for example, an air cleaner case 2, as described later) together with the plurality of supply pipe members. The plurality of pipe members, in an assembled state thereof, is fixed to the vehicle component together with the connection member. The connected pipe members are retained on the vehicle by the connection member via the clamping members.

In the fuel injection system according to the present invention, each of the plurality of injectors is detachably fittingly connected to respective one of the injector connecting portions of the supply pipe members. The injector engaging portions of the connection stay engagingly hold the plurality of injectors in desired positions.

The above fuel injection system according to the present invention may be assembled such that the fuel piping includes an introduction pipe member having the fuel introduction port and a supply pipe member having injector connecting portions; and the introduction pipe member is fittingly connected to the supply pipe member to be rotatable about an axis of the fuel path extending in the supply pipe member.

In the fuel injection system according to the present invention, the fuel piping includes resin pipe members. This makes it possible to reduce the weight of the fuel injection system. In addition, the pipe members can be produced with higher productivity compared to that of producing an undivided fuel piping. Also, the fuel injection system is assembled such that, when fixing the fuel piping to a vehicle component, the plural pipe members and a connection member are clamped together by clamping portions of the clamping members. Therefore, unlike in a case where they are clamped separately, it is not necessary to increase the number of clamping members. This makes it possible to simplify the structure of the connection member to increase efficiency of manufacturability and to reduce production cost thereof.

In the fuel injection system according to the present invention, the connection member is provided with injector engaging portions which allow the connection member to define the positions of insertion and detachment of the injectors, so that the fuel injection system can be assembled and installed with higher efficiency. Also, with the connection member having such a positioning arrangement, no special tools/parts for injector positioning are required. Therefore, it possible to reduce the number of required components and further reduce the weight of the fuel injection system.

Furthermore, in the fuel injection system according to the present invention, an introduction pipe member is fittingly and operatively connected to a supply pipe member to be rotatable about an axis of a fuel path extending in the supply pipe member, so that the angular position of a fuel introduction port can be set to a desired position. This increases the adaptability and applicability of the fuel injection system. Furthermore, the introduction pipe member and supply pipe member are fittingly and rotatably connected, so that no special tools for rotating the pipe members is required. This enables the pipe members to be produced with higher productivity and improves the ease of assembly of the pipe members.

For a more complete understanding of the present invention, the reader is referred to the following detailed description section, which should be read in conjunction with the accompanying drawings.

DETAILED DESCRIPTION OF THE ILLUSTRATIVE EMBODIMENTS

Figure 1:
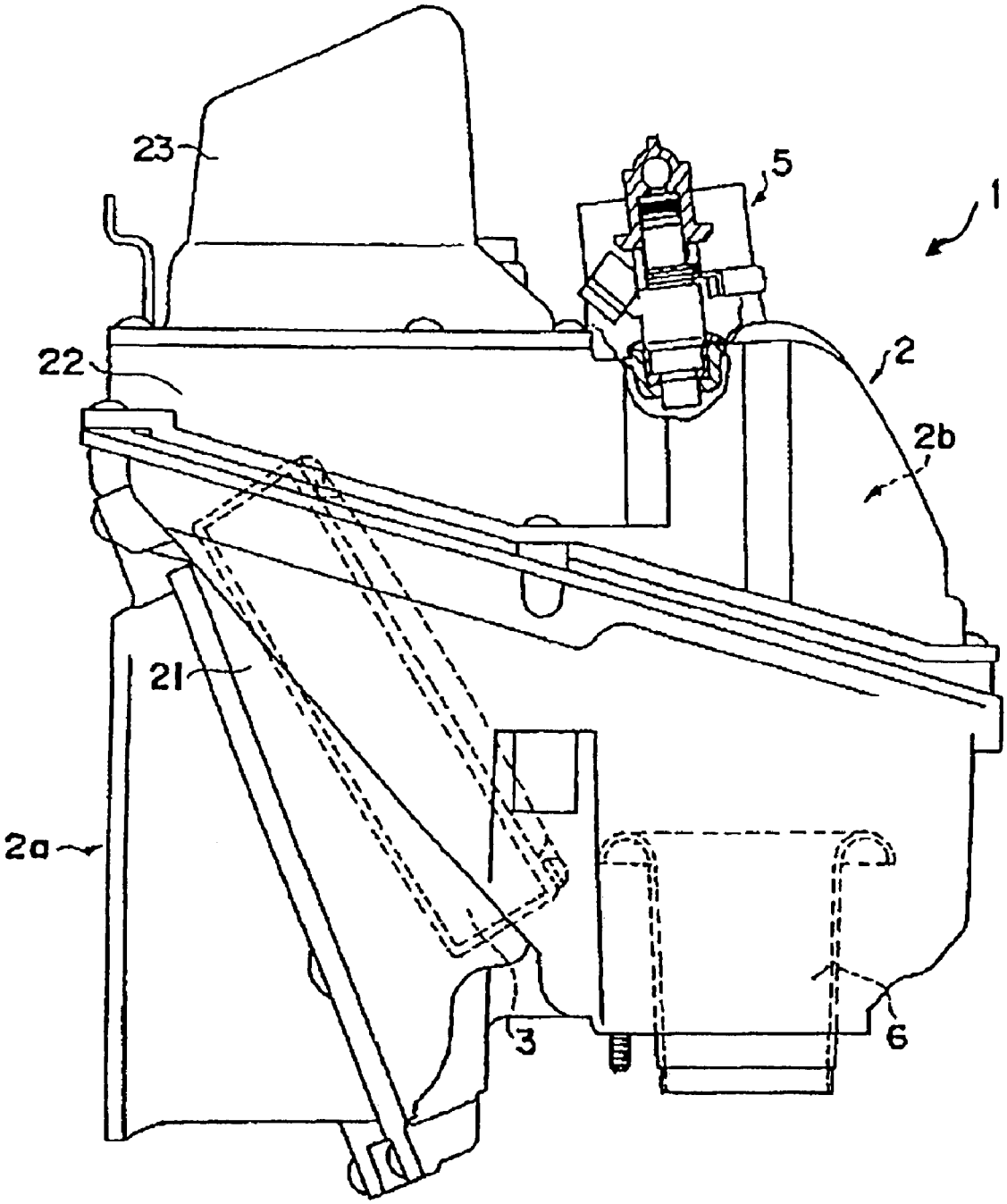
FIG. 1 is an overall view of an air cleaner assembly attached with a fuel injection system according to a first embodiment of the present invention.

A few selected illustrative embodiments of the present invention will now be described in detail, with reference to the accompanying drawings. It should be understood that only structures considered necessary for clarifying the present invention are described herein. Other conventional structures, and those of ancillary and auxiliary components of the system, are assumed to be known and understood by those skilled in the art. Throughout the following detailed description and in the drawings, like numbers refer to like parts.

Figure 3:
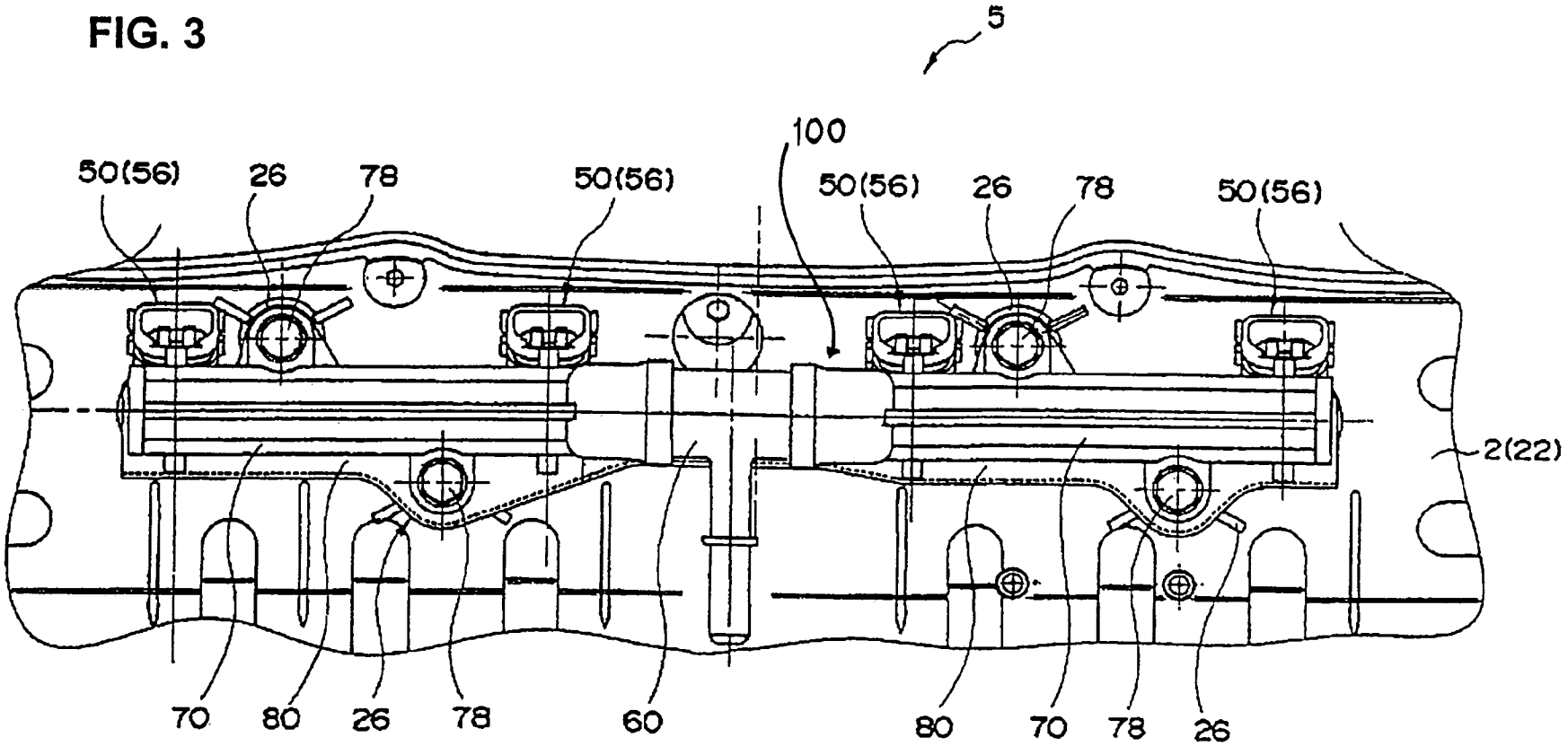
FIG. 3 is a plan view taken in a direction of arrow III in FIG. 2.

In the following description, upper and lower are as seen in FIG. 1; front and rear correspond to left and right as seen in FIG. 1; and left and right correspond to the front side and back side (not seen) of FIG. 1 (left and right as seen in FIG. 3).

A first embodiment of the present invention is described with reference to accompanying FIGS. 1-7. FIG. 1 shows an example of the present invention in which a fuel injection system 5 is attached to a vehicle component member (e.g., an air cleaner assembly 1) mounted on a motorcycle equipped with an inline four-cylinder internal combustion engine.

An overall configuration of the air cleaner assembly 1 is discussed with reference to FIG. 1. The air cleaner assembly 1 includes a box-like air cleaner case 2, a filter element 3 removably and replaceably fitted in the air cleaner case 2, a fuel injection system 5 which injects fuel at prescribed times, and an air funnel 6 which introduces an air-fuel mixture, i.e. filtered air mixed with fuel injected from the fuel injection system 5, into an intake port of the engine via a throttle valve.

The air cleaner case 2 includes a first case 21 which removably and replaceably holds the filter element 3 using an elastic clip, a second case 22 which covers an upper portion of the first case 21 and forms a filtered air chamber **2*b*, and a case cover 23 which covers an open top portion of the second case 22. These cases 21, 22 are resin-molded cases which are mutually flange-connected and fixed by screws. The first case 21 has an intake opening 2*a* formed in its front side (left side as seen in FIG. 1). The intake opening 2*a* introduces outside air into the first case 21. The outside air taken in through the intake opening 2*a* is introduced into the filtered air chamber 2*b* after being filtered by the filter element 3**.

The bell-mouthed air funnel 6 which communicates with the intake port of the engine is disposed, vertically extending through the first case 21, below the filtered air chamber **2*b*. The fuel injection system 5 that injects fuel toward the air funnel 6 is attached to an upper portion of the filtered air chamber 2*b*. The air taken in through the intake opening 2*a* and filtered by the filter element 3 is mixed with the fuel injected by the fuel injection system 5. The air-fuel mixture, i.e. the filtered air mixed with fuel, is then led to the intake port of the engine through the air funnel 6**.

Figure 2:
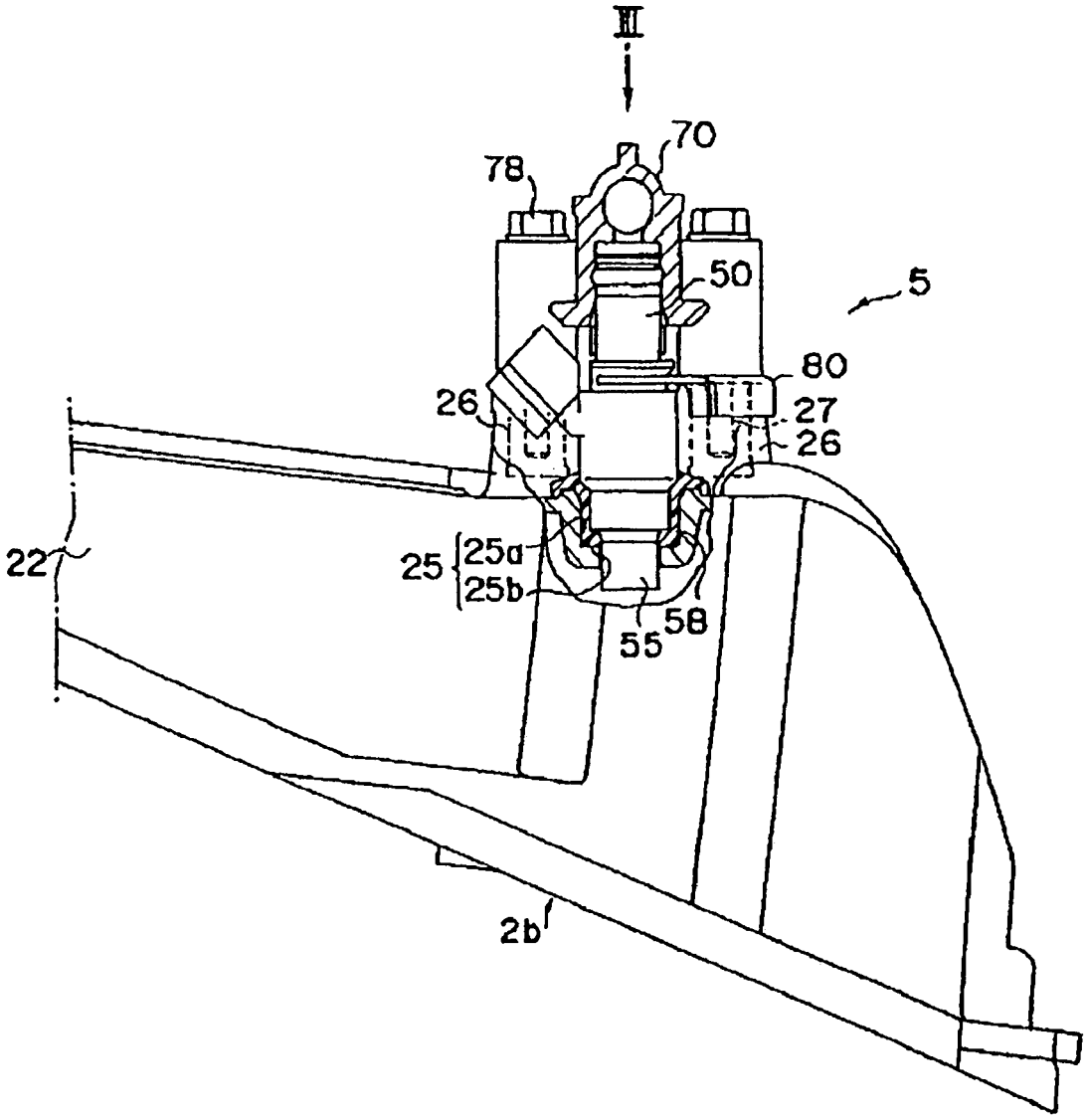
FIG. 2 is an enlarged (partly cross-sectional) view of the fuel injection system and a peripheral portion thereof.

Referring to FIG. 2 showing an enlarged (partly cross-sectional) view of the fuel injection system 5 and a peripheral portion thereof and to FIG. 3 showing a plan view in direction of arrow III in FIG. 2—in the air cleaner assembly 1, as discussed above—each of four injector receptacle 25 which accepts an end portion of an injector 50 and a fixing seat 26 which fixes the fuel injection system 5 are provided on an upper surface of the second case 22. The injector receptacle 25 includes a seal ring receiving groove **25*a* having a bottomed cylindrical shape in which a seal ring 58 is fitted. The injector receptacle 25 further includes a nozzle mouth 25*b* which is formed vertically extending through the bottom of the seal ring receiving groove 25*a* and through which an end portion of a nozzle 55 is inserted. In this configuration, when the fuel injection system 5 is installed, the end portion of the nozzle 55 is positioned in the filtered air chamber 2*b* with the seal ring 58 keeping the filtered air chamber 2*b* airtight. The fixing seat 26 has a cylindrical shape upwardly projecting from the upper surface of the second case 22. A metal bush having a female-threaded portion 27 is implanted in the fixing seat 26 thereby form a flat supporting surface over the fixing seat 26. The fixing seat 26** has reinforcement ribs formed thereon, which radially extend from its outer circumferential surface.

Figure 4:
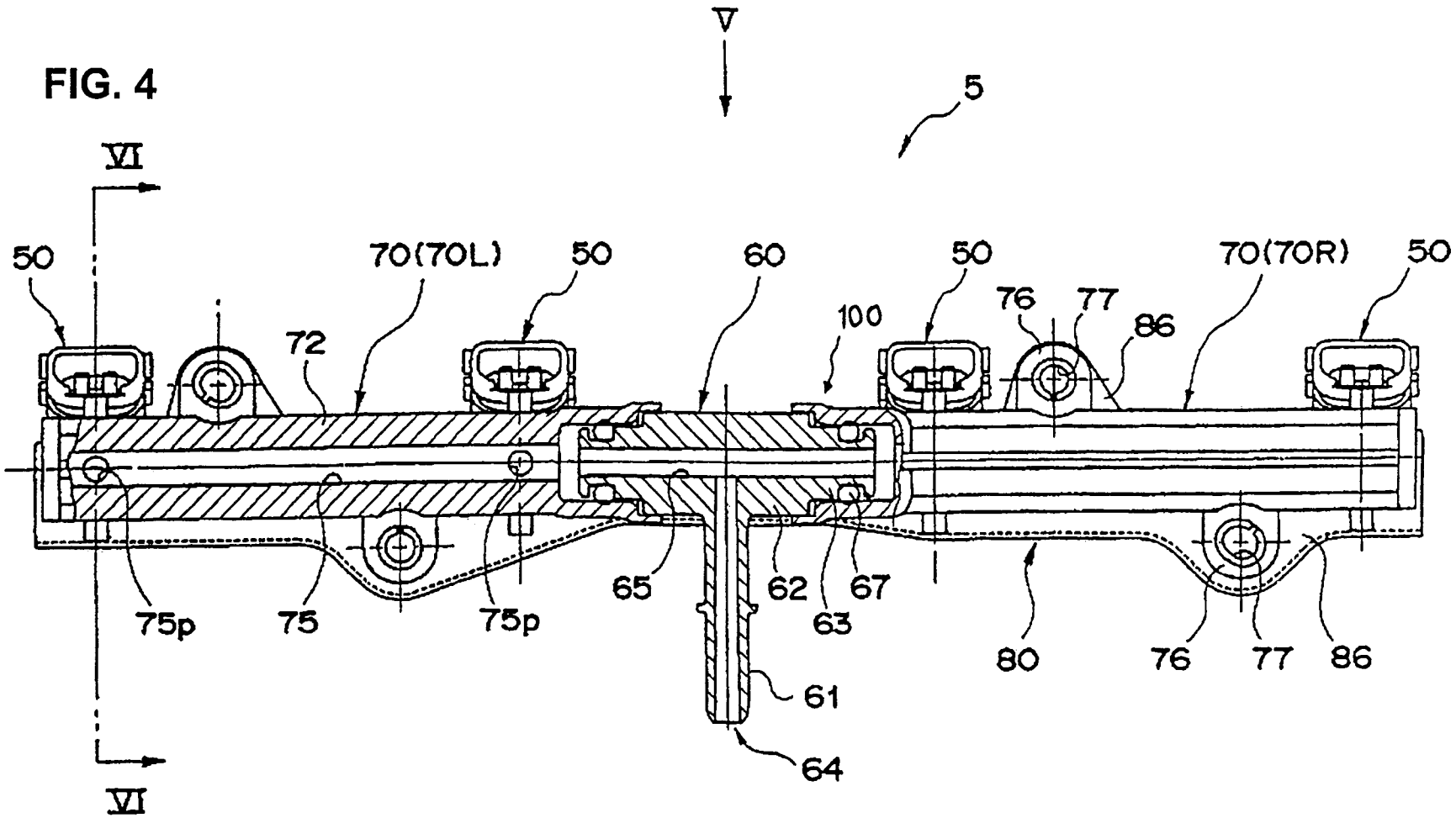
FIG. 4 is a cross-sectional view of an essential part of the fuel injection system taken in a direction of arrow III in FIG. 2.
Figure 5:
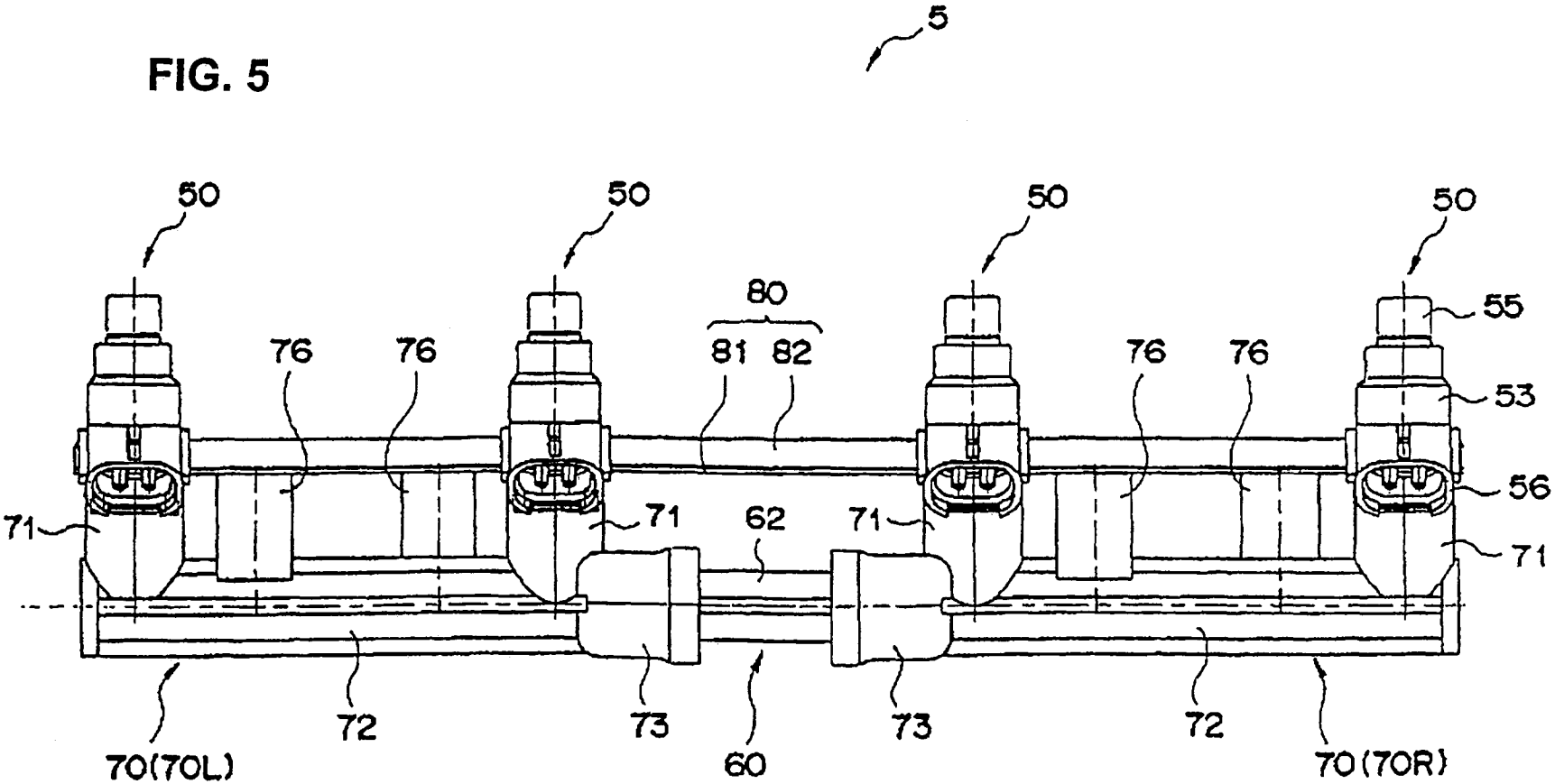
FIG. 5 is a plan view taken in a direction of arrow V in FIG. 4.
Figure 6:
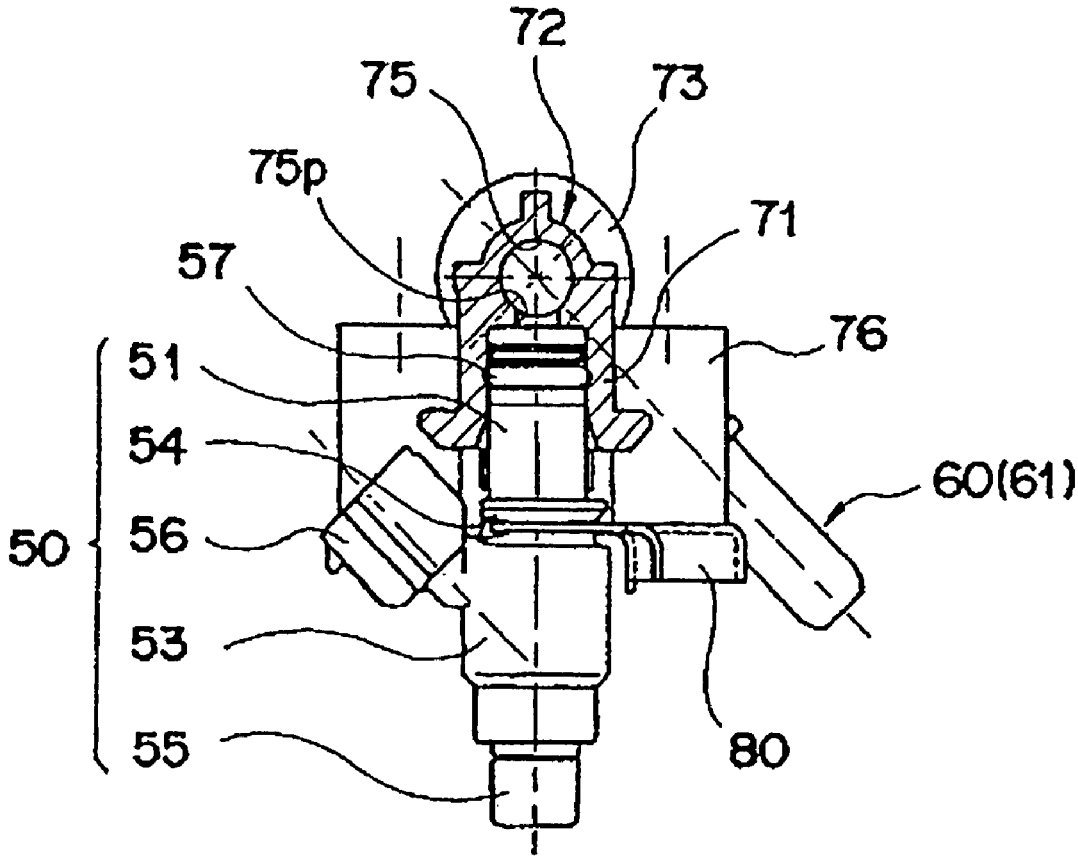
FIG. 6 is a cross-sectional view taken along line and viewed in a direction of arrows VI-VI in FIG. 4.

FIG. 4 is a cross-sectional view of an essential part of the fuel injection system 5 as seen in the same direction as in FIG. 3. FIG. 5 is a view taken in a direction of arrow V in FIG. 4. FIG. 6 is a cross-sectional view taken along arrow line VI-VI in FIG. 4. Referring to FIGS. 4-6, the fuel injection system 5 of the present invention generally includes four injectors 50 for injecting fuel, fuel pipes 60 and 70 for supplying fuel to the injectors 50, and a connection stay 80 (also referred as a connection member) which is fixed to the fixing seats 26 of the air cleaner assembly 1 together with the fuel pipes.

A fuel piping 100 includes an introduction pipe member 60 and a pair of left and right supply pipe members 70. The introduction pipe member 60 has a substantially T-shaped structure. The introduction pipe member 60 includes a fuel introduction port 64 for receiving fuel supplied (e.g., from a fuel tank) via a fuel pump (not shown). The left and right supply pipe members 70 are connected to arm portions of the introduction pipe member 60. Each of the pipe members 60, 70 is integrally formed, for example, by injection-molding out of resin material reinforced by glass fiber.

The T-shaped introduction pipe member 60 includes a cylindrical leg portion 61 and a cylindrical shoulder portion 62 (extension thereof including arm portion) connected to the leg portion 61. The shoulder portion 62 extends laterally forming arm portions. The cylindrical shoulder portion (arm portion) 62 has end portions thinner than the other portion thereof. Each of the end portions is formed as a fitting projection 63 to which one of the supply pipe members 70 is detachably fitted. The fitting projection 63 has an O-ring groove formed thereon to have an O-ring fitted therein.

The leg portion 61 of the introduction pipe member 60 includes a fuel introduction port 64 formed at the lower end thereof. The fuel introduction port 64 receives, through a fuel tube (not shown) connected thereto, fuel supplied from a fuel pump (not shown). A fuel path to be followed by the fuel received through the fuel introduction port 64 is formed through the axial centers of the leg portion 61 and shoulder portion 62. In other words, the fuel path is defined in along a longitudinal axis of shoulder portion 62.

The left supply pipe member (denoted by "70L") and right supply pipe member (denoted by "70R") are interchangeable members. They are assembled to be symmetrical about the introduction pipe member 60 connected between them. The injector positions (angular positions of electric connectors 56) of the supply pipe members 70 are set to differ 180 degrees between them. Each of the supply pipe members 70 include a cylindrical arm portion 72, two cylindrical injector connecting portions 71, and two cylindrical clamping parts 76 (also referred as clamping sections).

The cylindrical arm portion 72 extends laterally, and includes fins outwardly projecting from its circumference in four radial directions. The two cylindrical injector connecting portions 71 are downwardly projectingly formed in a base end portion and an outer end portion, respectively, of the arm portion 72 in a direction perpendicular to the axial direction of the arm portion 72. The two cylindrical clamping sections (parts) 76 are downwardly projectingly formed in two locations, respectively, on two sides across the arm portion 72. These two locations are spaced apart from each other along the arm portion 72 and are aligned with the corresponding fixing seats 26 provided on the second case 22 of the air cleaner assembly, as shown in FIG. 1.

The base end portion of the arm portion 72 is thicker than the other portion thereof. A cylindrical fitting concave portion 73 which can be detachably fitted to one of the fitting projections 63 of the introduction pipe member 60 is formed in the base end portion. A fuel path 75—that is followed by fuel being supplied—is formed through the axial center of the arm portion 72 of the supply pipe member 70. Each of the injector connecting portions 71 has a base end portion which is cylindrically formed such that a head portion 51 of the corresponding injector 50 can be detachably fitted therein.

A fuel supply port 75*p* which communicates with the fuel path 75 is formed in the base end portion. The injector connecting portions 71 each have a cylindrical outer end portion which has a front and a rear cutout through which the electrical connector 56 can be forwardly or backwardly led out. Each of the clamping parts 76 has a bolt insertion hole 77 formed therein to allow a fixing bolt to be inserted through the axial center thereof.

Figure 7:
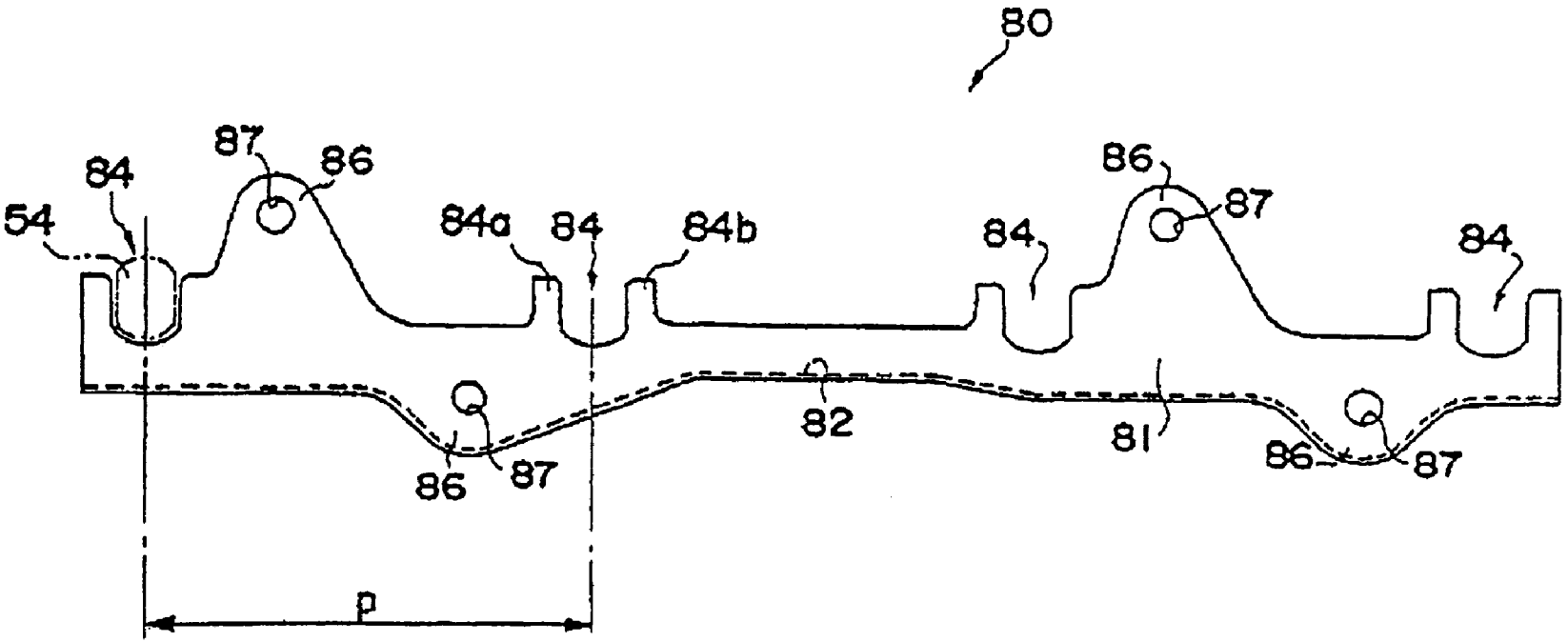
FIG. 7 is a plan view of a connection stay.

As shown in FIG. 7, the connection stay 80 (i.e., the connection member) is a laterally extending slender sheet metal component (part) having an upright edge portion 82 formed by downwardly perpendicularly bending a rear edge portion (lower edge portion as seen in FIG. 7) of a flat plate portion 81. The upright edge portion 82 enhances the bending rigidity and torsional rigidity of the connection stay 80. The connection stay 80 shaped as shown in FIG. 7 can be produced, for example, from a 0.8 to 1.2 mm thick rolled steel plate through blanking and press-forming followed by required surface treatment thereof. It will be understood from FIGS. 4 and 7 that the connection stay 80 is formed separately from the fuel piping 100, i.e., the connection stay 80 is formed separately from the supply pipe members 70 and the fuel introduction pipe member 60.

The plate portion 81 includes four U-shaped injector engaging portions 84. The injector engaging portions 84 each positions the corresponding one of the injectors 50 in the direction of injector insertion and detachment (in the direction perpendicular to the plane of the plate portion of FIG. 7), i.e., by engaging, in a manner of sandwiching between left and right side-piece portions 84*a* and 84*b*, a depressed portion 54 (see FIGS. 6 and 7) having an elliptical cross-section and being provided between the head portion 51 and a body portion 53 of the injector 50. At the same time, the injector engaging portions 84 also position the four injectors 50 relative to one another based on a predetermined pitch p in the lateral direction thereof.

The plate portion 81 also includes four supported portions 86 corresponding, in position and shape, to the fixing seats 26 on the second case 22 of the air cleaner assembly 22, and four bolt insertion holes 87 aligned with the female-threaded portions 27 of the fixing seat 26.

In the following paragraphs, a method of assembling the fuel injection system 5 is discussed.

The fuel injection system 5 can be assembled by putting the above-described members, i.e., the plurality of injectors 50, the introduction pipe member 60, the left and right supply pipe members 70, and the connection stay 80 together. It can then be attached to the air cleaner assembly 1 by fixing it to the fixing seats 26 on the second case 22 thereof.

An O-ring 57 is fitted on the head portion of each of the injectors 50. The injectors 50 are then fitted in the injector connecting portions 71, two each of which are provided at two locations on each of the left and right supply pipe members 70. The left and right supply pipe members 70L, 70R are required to be installed such that the positions, about the axes of the respective injector connecting portions 71, of the electrical connectors 56 differ 180 degrees between the left and right supply pipe members 70L, 70R. In other words, each of the electrical connectors 56 is required to be fitted such that, with the corresponding fitting concave portion 73 positioned on its right, the electrical connector 56 is positioned forward of the arm portion 72.

Next, an O-ring 67 is fitted on each of the left and right fitting projections 63 of the introduction pipe member 60. The left and right fitting projections 63 are then fitted in the left and right fitting concave portions 73 of the left and right supply pipe members, respectively, thereby engagedly connecting the left and right supply pipe members 70L and 70R to the introduction pipe member 60 such that the introduction pipe member 60 is disposed between the left and right supply pipe members 70L and 70R.

As a result, the fuel paths 75 formed through the left and right supply pipe members, respectively, fluidly communicate with a fuel path 65 formed through the introduction pipe member positioned between the left and right supply pipe members 70L, 70R. This establishes fuel paths connecting the fuel introduction port 64 to the head portions of the injectors 50. The cylindrical fitting projections 63 and cylindrical fitting concave portions 73 are fittingly connected via O-rings, so that the left and right supply pipe members 70L and 70R, and the introduction pipe member 60 connected between the left and right supply pipe members 70L and 70R are mutually relatively rotatable about the axis of the fuel path 75.

With the four injectors 50, the introduction pipe member 60, and the left and right supply pipe members 70L and 70R connected as described above with the introduction pipe member 60 coming in the middle, the relative rotational angles of the left and right supply pipe members 70L and 70R are adjusted such that the undersides of the clamping parts 76, two each of which are provided at two locations on each of the left and right supply pipe members 70L and 70R, are approximately in a same plane.

The connection stay 80 is slid from the rear side (the lower side as seen in FIG. 4, or the right side as seen in FIG. 6) along the undersides of the clamping parts 76 until the depressed portion 54 of each of the injectors 50 is engaged with the corresponding one of the four injector engaging portions 84 of the connection stay 80 in a manner of being sandwiched between the left and right side-piece portions 84*a* and 84*b* of the corresponding injector engaging portion 84, such that the four bolt insertion holes 77 in the injector engaging portions 84 and the four bolt insertion holes 87 in the connection stay 80 are aligned.

The above procedure completes positioning of each of the four injectors 50 both in the lateral direction and in the direction of injector insertion and detachment in the corresponding injector connecting portion 71, thereby completing sub-assembling of the fuel injection system 5.

Next, the sub-assembled fuel injection system 5 is attached to the air cleaner case 2. For this, initially the end portion of each of the injectors 50 is fitted with the seal ring 58. The end portions of the injectors 50 are then inserted in the four injector receptacles 25 provided on the upper surface of the second case 22. At this time, the end portion of the nozzle 55 of each of the injectors 50 projects into the filtered air chamber 2*b* through the nozzle mouth 25*b*, and the seal ring 58 is fitted in the seal ring receiving groove 25*a* thereby establishing an airtight seal between the second case 22 and the injector body portion 53.

With the supported portions 86 of the connection stay 80 abutted on and supported by the fixing seats 26 provided on the second case 22, the four each of bolt insertion holes 77 and 87 are aligned with the corresponding female-threaded portions 27, and a fixing bolt 78 is screwed, from above, in each of the female-threaded portions 27 through the corresponding bolt insertion holes and tightened. The connection stay 80 is thus integrally locked to an upper portion of the second case 22 in a state of being held between the clamping parts 76 of the left and right supply pipe members 70 and upper portions of the fixing seats 26 provided on the second case 22. Also, the four injectors 50, two each of which are supported on each of the left and right supply pipe members 70L, 70R, are engaged with the connection stay 80, positioned in the direction of injector insertion and detachment, causing the end portions of the four nozzles 55 uniformly positioned and projecting in the filtered air chamber 2*b*.

Subsequently, a fuel tube leading from a fuel pump (not shown) is connected to the leg portion of the introduction pipe member 60, and a connector connected to an engine control unit (ECU) is connected to the electrical connector 56 of each of the injectors 50. Now, the fuel injection system 5 attached to the air cleaner case 2 allows the fuel sent to the fuel introduction port 64 to be supplied to the injectors through the fuel paths 65 and 75 and then to be injected into the filtered air chamber at specified timings controlled by the ECU.

In an assembled fuel injection system 5, as discussed above, the left and right supply pipe members 70L and 70R are held, via the connection stay 80, to be laterally apart from each other by a constant predetermined distance. The introduction pipe member 60 and the left and right supply pipe members 70L and 70R that make up the fuel piping 100 of the fuel injection system 5 are held in a connected state by the connection stay 80. Such configuration, i.e., pipe members 60, 70L and 70R commonly held by connection stay, makes it possible to use segmented, shorter length fuel pipes made of a light resin material.

Furthermore, even in cases in which the fuel injection system 5 is attached to a vehicle component (the air cleaner 2) made of a resin material, which is, while excelling in lightness, relatively inferior in terms of thermal deformation and rigidity, it is possible to provide a light, inexpensive configuration in which the connection stay 80 can minimize relative positional shifting between the fuel pipes 60 and 70 while ensuring fuel tightness between them by providing leak-proof fuel piping.

The fuel piping to which the four injectors 50 are connected is divided into the interchangeable left and right supply pipe members 70, resulting in improved resin moldability in manufacturing the pipe members and higher productivity. The left and right supply pipe members 70 L, 70R to which the four injectors 50 are fitted are axially connected via the introduction pipe member 60. The connection stay 80 fixes the injectors 50 to the supply pipe members 70 in the vertical direction. This secures the injector fitting strength while making the injectors easily fittable. The supply pipe members 70 does not require any special structure for preventing the injectors from falling, so that injectors can have a simple structure to facilitate a weight reduction.

The introduction pipe member 60 supported between the left and right supply pipe members 70L and 70R is fittingly connected to be rotatable up to approximately 270 degrees about the axis of the fuel path 75 (see FIG. 6), so that the fuel introduction port 64 can be appropriately positioned, as required. This increases the flexibility of mounting of the fuel injection system 5 on the vehicle.

Figure 8:
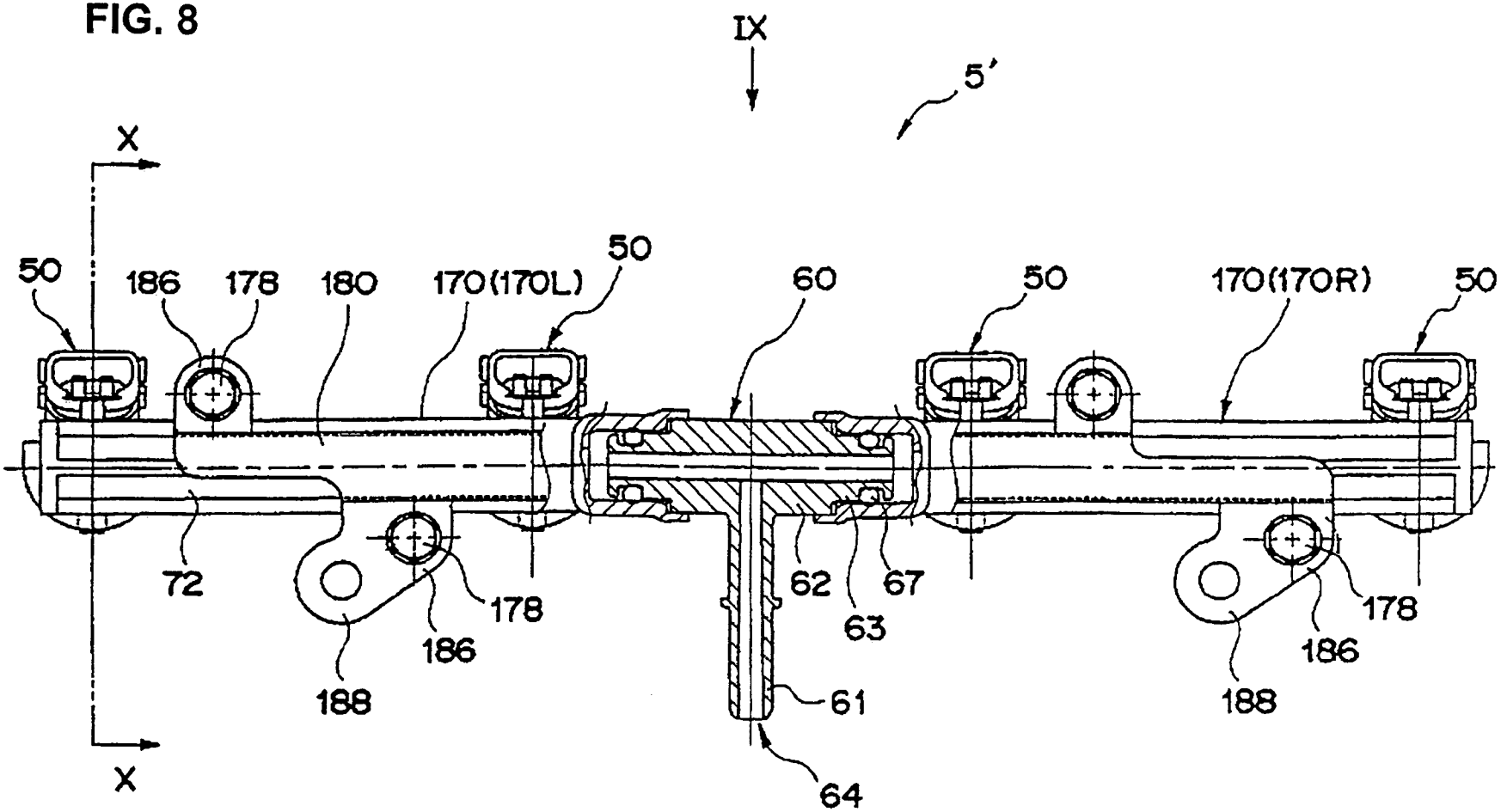
FIG. 8 is a cross-sectional view of an essential part of a fuel injection system according to a second embodiment.
Figure 9:
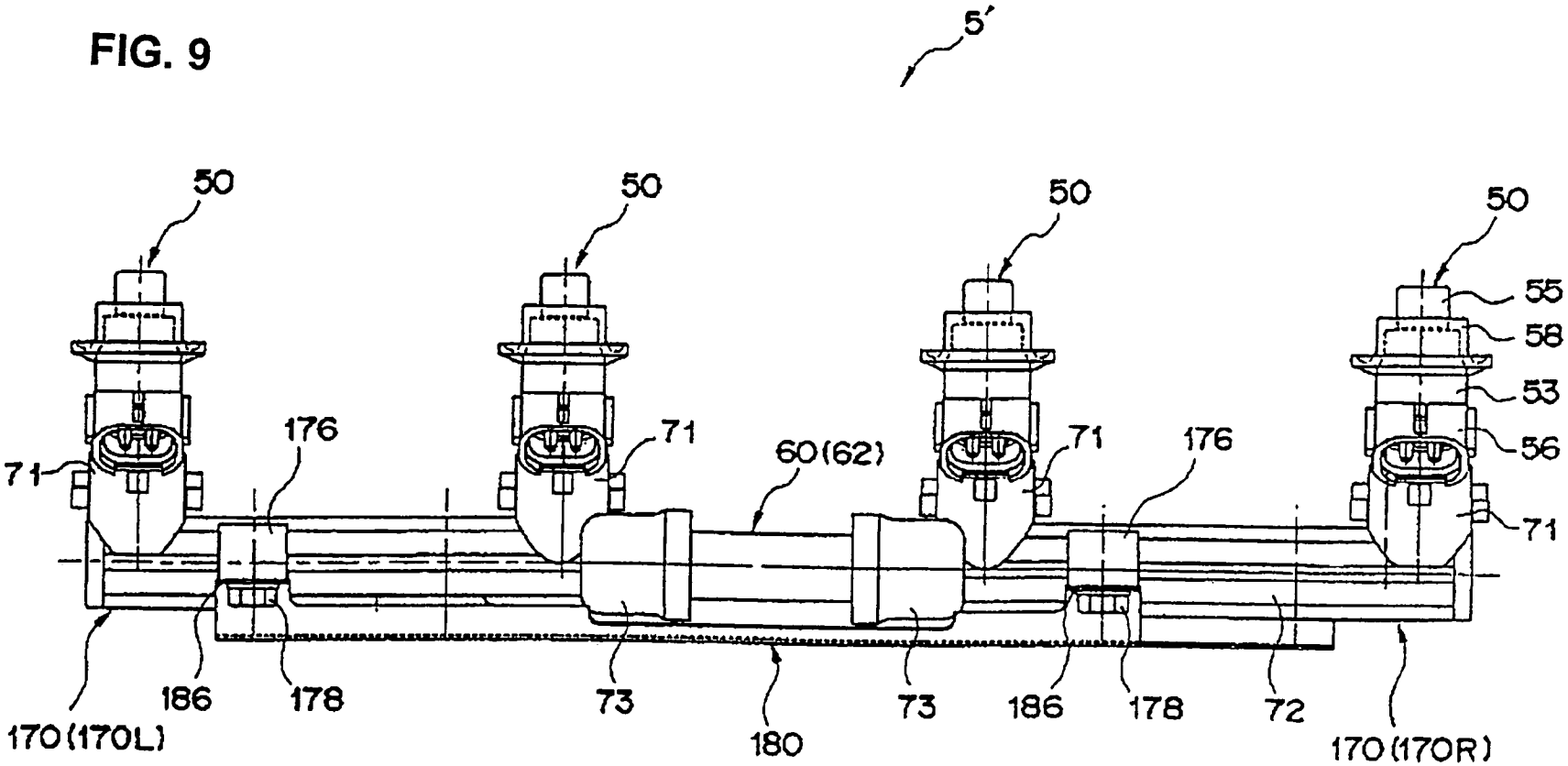
FIG. 9 is a view taken in direction of arrow IX in FIG. 8.
Figure 10:
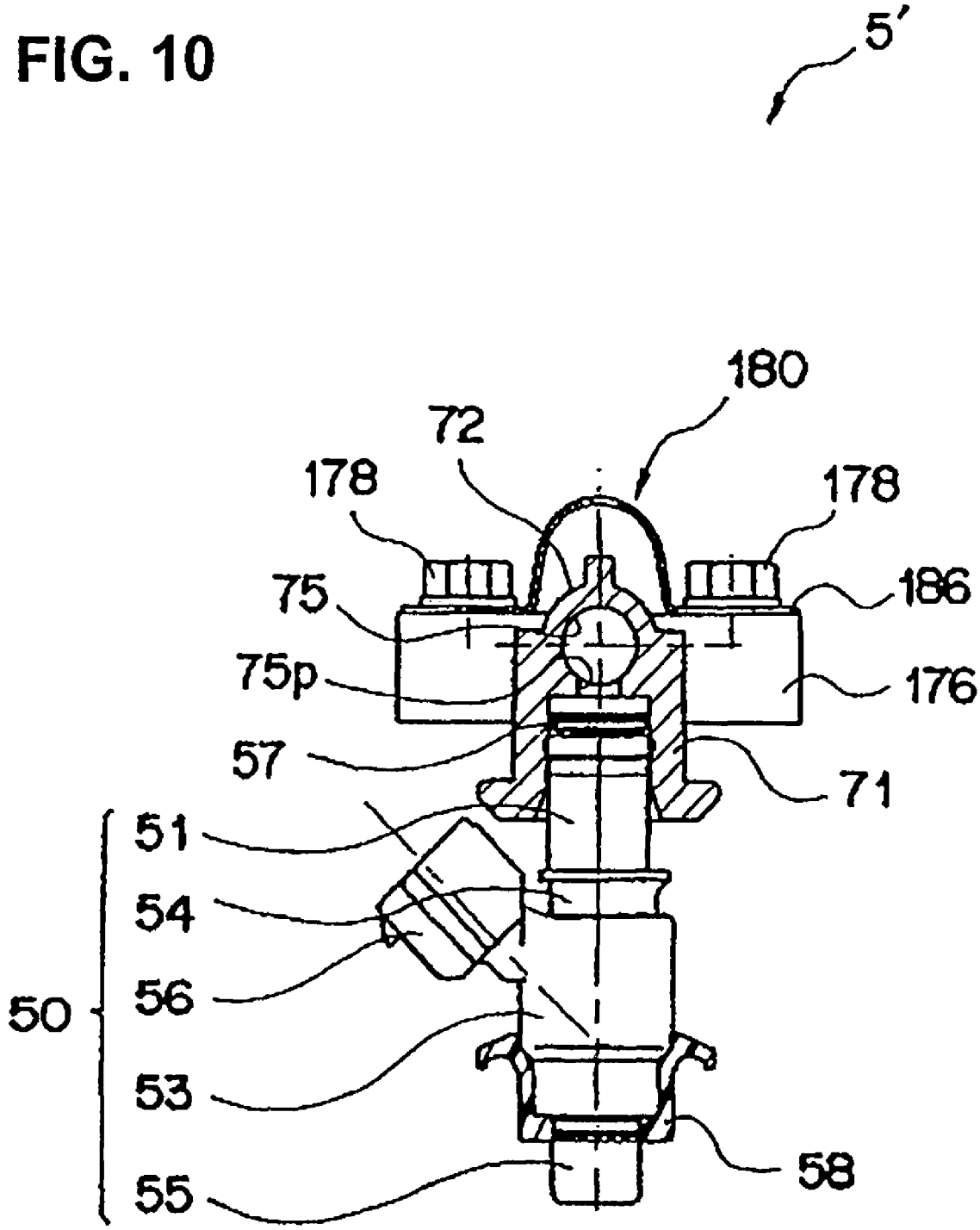
FIG. 10 is a cross-sectional view taken along line X-X in FIG. 8 and viewed in the direction of arrows.

A fuel injection system 5 according to a second embodiment of the present invention is briefly discussed with reference to FIGS. 8-10. FIG. 8 is a cross-sectional view of an essential part of the fuel injection system 5 as seen in the same direction as in FIG. 4, as discussed hereinabove. FIG. 9 shows a view in direction of arrow IX in FIG. 8. FIG. 10 is a cross-sectional view taken along line and viewed in direction of arrow line X-X in FIG. 8.

In the following, the components having same-structure as those of the fuel injection system 5 of the first embodiment will be denoted by the same reference numerals and their description will be omitted to avoid duplication.

The fuel injection system 5 according to the second embodiment includes four injectors 50, an introduction pipe member 60 for supplying fuel to the injectors 50; left and right supply pipe members 170 which are each fittingly connected, to be axially rotatable, to the introduction pipe member 60 via an O-ring 67, the left and right supply pipe members 170 each having a fitting concave portion 73 detachably fittable to a fitting projection 63 of the introduction pipe member 60; and a connection stay 180 which is fixed, together with the left and right supply pipe members, to fixing seats 26 of an air cleaner case 2.

In other words, even though the supply pipe members 170 and the connection stay 180 included in the fuel injection system 5 are assembled differently from the corresponding parts of the first embodiment, the basic configuration of the fuel injection system 5 of the second embodiment is similar to that of the fuel injection system 5 of the first embodiment.

According to the second embodiment, each of the supply pipe members 170 includes a cylindrical arm portion 72 extending laterally and having fins outwardly projecting in four radial directions. The cylindrical arm portion 72 includes two cylindrical injector connecting portions 71, 71 formed downwardly projectingly in a base end portion and an outer end portion, respectively, in a direction perpendicular to the axial direction of the arm portion 72. The cylindrical arm portion also includes two cylindrical clamping parts (sections) 176 formed in two locations, respectively, on two sides across the arm portion 72. In other words, the clamping parts are formed at two locations apart from each other along the arm portion 72 and aligned with the corresponding fixing seats 26 provided on the second case 22.

The fitting concave portion 73 formed in the arm portion 72 is detachably fitted to one of the fitting projections 63 of the introduction pipe member 60. A fuel path 75 to be followed by fuel supplied from a fuel source is formed through the axial center of the arm portion 72. Fuel supply ports 75*p* communicate with the corresponding injector connecting portions 71 and the fuel path 75. The fuel ports 75*p* and fuel path 75 are formed in the arm portion 72 (see FIG. 4). Each of the clamping parts 176 has a bolt insertion hole 77 formed therein, which allows fixing a bolt at the axial center of the clamping part 176.

The connection stay 180 is a laterally extending slender sheet metal part somewhat shorter than the connection stay 80 described in the first embodiment. It is produced by press-forming out of a metallic material similar to that of the connection stay 80. As seen in FIG. 10, the connection stay 180 is shaped like an arch straddling an upper portion of the arm portion 72. The connection stay 180 includes fixing flange portions 186 bent to be horizontal so that they are positionally and shapely aligned with the four fixing seats provided on the second case 22. Each of the fixing flange portions 186 has a bolt insertion hole formed therein at a location aligned with a corresponding female-threaded part 27.

In the following paragraphs, a method of attaching the fuel injection system 5 according the second embodiment is discussed.

In order to attach the fuel injection system 5 to the air cleaner case 2, the injectors 50 are fitted to the injector connecting portions 71; the fitting concave portions 73 of the supply pipe members 170 are fittingly connected to the left and right fitting projections 63 of the introduction pipe member 60, respectively; the connection stay 180 is placed over the supply pipe members 170 and introduction pipe member 60. The pipe members 60, 70 are thus connected and covered by the connection stay 180 which is fixed to the fixing seats 26 provided on the second case 22.

The fixing seats 26 used in the second embodiment are formed to be more upwardly projecting than the above-described fixing seats 26 of the first embodiment. The clamping parts 176 of the supply pipe members 170 are abutted on and supported by the fixing seats 26. In this state, fixing bolts 178 are screwed, from above the fixing flange portions 186, in the female-threaded parts and tightened. This completes attaching of the fuel injection system 5 to the air cleaner case 2.

In the assembled fuel injection system 5, as discussed above, similar to the first embodiment, the left and right supply pipe members 170 are held, via the connection stay 180, to be laterally apart from each other by a constant predetermined distance, and the introduction pipe member 60 and the left and right supply pipe members 170 are held in a connected state by the connection stay 180.

It is therefore possible to provide a light, inexpensive configuration in which the connection stay 180 can minimize relative positional shifting between the fuel pipes 60 and 170 while ensuring fuel tightness (i.e., by providing leak-proof fuel piping) between them. The introduction pipe member 60 supported between the left and right supply pipe members 170 is fittingly connected to be rotatable about the axis of the fuel path 75, so that the fuel introduction port 64 can be appropriately positioned, as required. This increases the mounting flexibility of the fuel injection system on the vehicle.

The fuel piping is divided into the interchangeable left and right supply pipe members 170, resulting in improved resin moldability in producing the pipe members and higher manufacturing productivity while also making piping assembly easier. The supply pipe members 170 do not require any special structures for preventing the injectors 50 from falling, so that they can have a simple structure to facilitate a weight reduction.

As shown in FIG. 8, an alternative configuration may be arranged. For example, one of the fixing flange portions 186 of each of the supply pipe members 170 is provided with an extra, additional extended area wherein a supported portion 188 supported by and fixed to the corresponding fixing seat 26 provided on the air cleaner case 2. With such extended supported portion 188, at least one of the left and right clamping parts 176 of each of the supply pipe members 170 includes a portion that that can be fixedly connected to the connection stay 180. This makes attaching the fuel injection system 5 to the air cleaner case 2 further easier.

Even though, in the embodiments described above, each of the left and right supply pipe members has two injector connecting portions provided in two locations, the number of the injector connecting portions provided on each of the left and right supply pipe members may also be one, or three or more. Also, in the above embodiments, the fuel injection system is attached to the air cleaner case 2, but the fuel injection system may be attached to a different vehicle component, for example, an engine component such as a throttle body.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A fuel injection system, comprising:

a plurality of injectors for injecting fuel;

a fuel piping having a fuel introduction port for receiving fuel being supplied;

a fuel path extending from the fuel introduction port, a plurality of injector connecting portions provided along the fuel path;

a plurality of clamping parts for fixing said fuel piping to a vehicle; and a connection member formed separately from said fuel piping;

wherein said fuel path supplies fuel to a plurality of injectors connected to the injector connecting portions;

the fuel piping is divided into a plurality of resin supply pipe members across a longitudinal direction in which the fuel path extends;

the connection member is aligned with said plurality of clamping parts formed on the plurality of pipe members in a connected state thereof;

said connection member is fixed to a component of the vehicle together with the plurality of pipe members; and the plurality of pipe members are retained by the connection member via the clamping parts when the plurality of pipe members in said connected state thereof are fixed to the vehicle component together with the connection member.

2. The fuel injection system according to claim 1, wherein the introduction pipe member is fittingly connected to each of the supply pipe members, and wherein said introduction pipe member is rotatable about an axis of the fuel path extending in the supply pipe members.

3. The fuel injection system according to claim 1, wherein said vehicle component is made of resin material.

4. The fuel injection system according to claim 1, wherein said vehicle component is an air cleaner assembly comprising a resin material.

5. The fuel injection system according to claim 1, wherein said connection member extends along a longitudinal portion of said fuel piping.

6. The fuel injection system according to claim 1, wherein each of the plurality of injectors is detachably fittingly connected to a respective one of said injector connecting portions; and the connection member is provided with injector engaging portions, each of which engagingly hold one of the plurality of injectors in a position, wherein each of the plurality of injectors is fittingly connected in a direction of insertion and detachment.

7. The fuel injection system according to claim 6, wherein the introduction pipe member is fittingly connected to each of the supply pipe members and wherein said introduction pipe member is rotatable about an axis of the fuel path extending in the supply pipe members.

8. The fuel injection system according to claim 6, wherein each of said injection engaging portions of said connection member has a U-shaped cross section.

9. A fuel injection system for a multi-cylinder internal combustion engine; said fuel injection system comprising a fuel introduction pipe member having a leg portion and a pair of shoulder portions, each connected to said leg portion; said leg portion having a fuel introduction port which receives fuel from a fuel source;

a pair of supply pipe members, each of said supply pipe members operatively connected to respective one of said shoulder portions of said fuel introduction pipe member;

a connection stay which holds said fuel introduction pipe member and said supply pipe members in an assembled state thereof; said connection stay being formed separately from said supply pipe members and said fuel introduction pipe member; and a plurality of injectors operatively connected with each of said supply pipe members;

wherein said supply pipe members are formed of resin material.

10. A fuel injection system according to claim 9, wherein said introduction pipe member is formed by a process including injection-molding of resin material reinforced by glass fiber.

11. A fuel injection system according to claim 9, wherein said resin material is reinforced by glass fiber.

12. A fuel injection system according to claim 9, wherein said connection stay includes a plurality of injector engaging portions, wherein each of said injector engaging portions receives one of said plurality of said injectors.

13. A fuel injection system according to claim 9, wherein said introduction pipe member and said supply pipe members define a fuel path having an axis; and wherein said introduction pipe member and said supply pipe members are mutually relatively rotatable about the axis.

14. A fuel injection system according to claim 9, wherein each of said supply pipe members include a plurality of clamping parts; and wherein said supply pipe members are connected to the connection stay via said clamping parts.

15. A fuel injection system according to claim 14, wherein one of said clamping parts of each of said supply pipe members includes an extended supported portion which is fixed to a fixing seat of a vehicle component.

16. A fuel injection system according to claim 9, wherein said connection stay is attached to a vehicle component made of resin material.

17. A fuel injection system according to claim 16, wherein said vehicle component is an air cleaner assembly having a plurality fixing seats which receive said connection stay.

18. An internal combustion engine for a vehicle, said engine comprising a plurality of cylinders; and a fuel injection system for supplying fuel to said plurality of cylinders;

said fuel injection system comprising an air cleaner assembly;

a fuel introduction pipe member having a leg portion and a shoulder portion connected to said leg portion; said leg portion having a fuel introduction port which receives fuel from a fuel source;

a plurality of supply pipe members, each of said supply pipe members operatively connected to said shoulder portion of said fuel introduction pipe member;

a connection stay which holds said fuel introduction pipe member and said supply pipe members in an assembled state thereof; said connection stay being formed separately from the supply pipe members and said fuel introduction pipe member; and a plurality of injectors, each of said injectors operatively connected with a respective one of said cylinders and a respective one of said supply pipe members;

wherein said connection stay is connected to the air cleaner; and said introduction pipe member and said supply pipe members are formed of a resin material reinforced by glass fiber.

19. An internal combustion engine according to claim 18, wherein said air cleaner includes a plurality of fixing seats configured to receive said connection stay holding said introduction pipe member and said supply pipe members.

20. An internal combustion engine according to claim 18, wherein said introduction pipe member and said supply pipe members define a fuel path having an axis; and wherein said introduction pipe member and said supply pipe members are mutually relatively rotatable about the axis.

21. An internal combustion engine according to claim 18, wherein said connection stay includes a plurality of injector engaging portions, wherein each of said injector engaging portions receives one of said injectors.

22. An internal combustion engine according to claim 18, wherein said connection stay is formed of rolled steel plate sheet metal having a thickness in a range of 0.8 to 1.2 mm.

* * * * *